US008139990B2

(12) United States Patent
Okada et al.

(10) Patent No.: US 8,139,990 B2
(45) Date of Patent: Mar. 20, 2012

(54) DEVELOPING DEVICE AND IMAGE FORMING APPARATUS

(75) Inventors: Takuya Okada, Toyokawa (JP); Takuya Sasaki, Toyokawa (JP); Hokuto Hatano, Toyokawa (JP); Hiroshi Goto, Okazaki (JP); Junji Murauchi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 372 days.

(21) Appl. No.: 12/477,177

(22) Filed: Jun. 3, 2009

(65) Prior Publication Data

US 2009/0304415 A1 Dec. 10, 2009

(30) Foreign Application Priority Data

Jun. 10, 2008 (JP) ..... 2008-151790

(51) Int. Cl.
*G03G 15/08* (2006.01)

(52) U.S. Cl. ..... 399/281

(58) Field of Classification Search ..... 399/281
See application file for complete search history.

(56) References Cited

U.S. PATENT DOCUMENTS

| | | | | |
|---|---|---|---|---|
| 5,594,198 | A | 1/1997 | Ikeda et al. | |
| 6,519,437 | B1 | 2/2003 | Aoki et al. | |
| 6,539,193 | B1 * | 3/2003 | Aoki et al. | 399/281 |
| 7,349,646 | B2 | 3/2008 | Choi et al. | |
| 2003/0012589 | A1 * | 1/2003 | Kanari et al. | 399/281 |
| 2003/0113139 | A1 | 6/2003 | Yasukawa et al. | |
| 2003/0113140 | A1 * | 6/2003 | Miyasaka et al. | 399/281 |
| 2007/0286647 | A1 * | 12/2007 | Sano et al. | 399/281 |

FOREIGN PATENT DOCUMENTS

| | | | |
|---|---|---|---|
| JP | 7-072732 | A | 3/1995 |
| JP | 08-036299 | | 2/1996 |
| JP | 2002-244437 | | 8/2002 |
| JP | 2002-365908 | | 12/2002 |
| JP | 2003-107903 | A | 4/2003 |
| JP | 2003-330261 | | 11/2003 |

(Continued)

OTHER PUBLICATIONS

Preliminary Notice of Rejection issued in the corresponding Japanese Patent Application No. 2008-151790 dated Apr. 27, 2010, and an English Translation thereof.

(Continued)

*Primary Examiner* — Sophia S Chen
(74) *Attorney, Agent, or Firm* — Buchanan Ingersoll & Rooney PC

(57) ABSTRACT

A developing device including a housing, toner a developing roller, and a feed roller in pressure contact with the developing roller so as to form a nip portion and which feeds toner to the developing roller. The developing device including a feed stabilizing member contacting a lower portion of the feed roller so as to form a second nip portion and restricting toner feed quantity. The feed stabilizing member extending from a generally triangular-shaped first region below the first nip portion up to one side of the nip portion opposite to the first region side. The developing device further including a toner circulation path for pushing back toner from the first region through below the feed stabilizing member to a second region on the one side opposite to the first region side with an aid of pressure of toner that tends to accumulate in the first region.

20 Claims, 5 Drawing Sheets

FOREIGN PATENT DOCUMENTS

| | | | |
|---|---|---|---|
| JP | 2004-163789 | | 6/2004 |
| JP | 2005-128525 | | 5/2005 |
| JP | 2006-098854 | A | 4/2006 |
| JP | 2006-098855 | A | 4/2006 |
| JP | 2007-003889 | A | 1/2007 |

OTHER PUBLICATIONS

Decision to Patent Grant dated Aug. 31, 2010, issued in the corresponding Japanese Patent Application No. 2008-151790, and an English Translation thereof.

* cited by examiner

*Fig.6*

| No. | FEED STABILIZING MEMBER | STRUCTURE TYPE | LENGTH 22a (mm) | LENGTH 23b (mm) | DISTANCE 21c (mm) | POTENTIAL | EVALUATION | | |
|---|---|---|---|---|---|---|---|---|---|
| | | | | | | | FEED STABILITY | TONER PACKING | TOTAL |
| C1 | NOT PROVIDED | — | — | — | — | EQUAL | × | ○ | × |
| C2 | PROVIDED | A | 0.5 | 0.5 | 2 | EQUAL | ○ | × × | × |
| C3 | PROVIDED | A | 3 | 30 | 2 | EQUAL | ○ | × | × |
| E1 | PROVIDED | A | 3 | 1.5 | 2 | EQUAL | ○ | ○ | ○ |
| E2 | PROVIDED | A | 3 | 1.5 | 2 | FLOAT | △ | ○ | ○ |
| E3 | PROVIDED | A | 3 | 3 | 2 | EQUAL | ○ | ○ | ○ |
| E4 | PROVIDED | A | 5 | 1 | 2 | EQUAL | ○ | △ | ○ |
| E5 | PROVIDED | A | 3 | 10 | 2 | EQUAL | ○ | △ | ○ |
| E6 | PROVIDED | A | 3 | 1.5 | 6 | EQUAL | ○ | △ | ○ |
| E7 | PROVIDED | A | 3 | 1.5 | 1 | EQUAL | ○ | ○ | ○ |
| E8 | PROVIDED | B | 3 | 3 | 2 | EQUAL | ○ | ○ | ○ |
| E9 | PROVIDED | C | 3 | 3 | 2 | EQUAL | ○ | ○ | ○ |

DEVELOPING DEVICE AND IMAGE FORMING APPARATUS

This application is based on an application No. 2008-151790 filed on Jun. 10, 2008 in Japan, the entire content of which is hereby incorporated by reference.

TECHNICAL FIELD

The present invention relates to developing devices, more specifically, to a developing device to be used in electrophotographic image forming apparatuses such as copiers and printers.

The invention also relates to image forming apparatuses including such a developing device.

BACKGROUND ART

In electrophotographic image forming apparatuses, generally, a photoconductor is exposed to light so that an electrostatic latent image is formed on a surface of the photoconductor, and the electrostatic latent image is developed by a developing device to form a toner image on the surface of the photoconductor, the toner image being then transferred and fixed to a sheet as a recording medium.

As a developing device of this type of prior art, described in, for example, JP 2006-98854 A and JP 2006-98855 A is one which includes a casing, a developing roller for conveying toner to a photoconductor, a feed roller for feeding toner under pressure contact with the developing roller, a restricting blade for restricting toner, a toner agitating/conveying member for agitating and conveying toner, and a toner receiving member for receiving the toner conveyed by the toner agitating/conveying member and guiding the toner toward the feed roller. The developing roller is placed at an opening of the casing so as to be almost in contact with the photoconductor, while the feed roller, the restricting blade, the toner agitating/conveying member and the toner receiving member are all placed within the casing. The developing roller and the feed roller are rotated in an equal direction around their respective center axes, so that at a nip portion between the developing roller and the feed roller, their respective outer peripheral surfaces slide in contact with each other in mutually counter directions. The restricting blade is set in the casing in contact with a portion of the developing roller lower than the nip portion to restrict the toner on the developing roller fed from the feed roller.

Also disclosed in JP 2007-3889 A, JP 2002-244437 A and JP 2003-107903 A is a developing device of prior art having a generally similar construction in which members (called paddle, agitator and conveyor blade, respectively; hereinafter, referred to as "toner agitating/conveying members etc.") equivalent to the toner agitating/conveying member are provided below a nip portion between a developing roller and a feed roller.

SUMMARY OF INVENTION

Technical Problem

As shown above, when the developing roller and the feed roller slide in contact with each other in counter directions at the nip portion therebetween, there is a tendency that toner packing occurs in a region beneath the nip portion between the developing roller and the feed roller (i.e., a generally triangular-shaped region surrounded by a surface of the developing roller and a surface of the feed roller). Upon occurrence of the toner packing, gears that drive the developing roller and the feed roller may become less easy to rotate, so that, in some cases, the gears may rattle and cause deterioration of image quality or breaks of the gears.

In the developing devices of the prior art described above, the toner agitating/conveying members etc., which are placed below the nip portion between the developing roller and the feed roller, convey the toner, which drops downward from the nip portion between the developing roller and the feed roller by its own weight, to the toner receiving member placed upward. Thus, by providing a relatively wide space for the toner to drop below the nip portion between the developing roller and the feed roller, the occurrence of toner packing in the region beneath the nip portion between the developing roller and the feed roller is prevented.

However, by including such toner agitating/conveying members etc. (driven by drive sources) as described above, there is a problem that the developing device becomes large-sized and complex in structure.

Accordingly, an object of the present invention is to provide a developing device which can prevent the occurrence of toner packing and yet which can be made up in small size with simplicity.

Another object of the invention is to provide an image forming apparatus including such a developing device.

Solution to Problem

In order to achieve the object, a developing device according to the present invention comprises:

a housing in which nonmagnetic one-component toner is housed;

a developing roller which horizontally extends in an opening of the housing;

a feed roller which is set in the housing parallel to the developing roller in pressure contact with the developing roller so as to form a first nip portion and which is rotated in a direction equal to a rotational direction of the developing roller so as to feed toner to the developing roller; and a feed stabilizing member which is placed within the housing and is in contact with an upstream-side portion of the feed roller lower than the first nip portion, the upstream side being referred to along the rotational direction, so as to form a second nip portion, and which restricts toner feed quantity from the feed roller to the developing roller, the feed stabilizing member being provided so as to extend from a generally triangular-shaped first region, which is surrounded by a portion of the developing roller lower than the first nip portion and a portion of the feed roller lower than the first nip portion, to one side of the second nip portion opposite to the first region side; and a toner circulation path for pushing back toner from the first region through below the feed stabilizing member to a second region corresponding to a place upper than the feed stabilizing member on the one side of the second nip portion opposite to the first region side with an aid of pressure of toner that tends to accumulate in the first region.

It is noted here that the terms, "lower" and "upper," are determined according to a direction of gravity.

According to the developing device of this invention, the feed roller is set in parallel pressure contact with the developing roller so as to form the first nip portion, and is rotated in a direction equal to the direction of rotation of the developing roller. Then, the toner housed in the housing, particularly toner present around the feed roller, is conveyed along with the rotation of the feed roller so as to be fed from the second region to the second nip portion. Then, a feed quantity of toner from the feed roller to the developing roller is restricted at the second nip portion. As the feed roller is further rotated, the toner restricted at the second nip portion is conveyed so as to be fed to the first nip portion between the feed roller and the developing roller. As a result, the toner is fed from the feed roller to the developing roller, and is carried on the outer peripheral surface of the developing roller. By the developing roller being rotated, the toner on the outer peripheral surface of the developing roller is restricted by, for example, a known restricting member, and thereafter put to use for development of an electrostatic image to the surface of the photoconductor, which is an object of development by the developing device.

When the feed roller feeds toner to the developing roller, toner that has not adhered to the developing roller at the first nip portion tends to accumulate in the first region. In this developing device, the toner that has not been adhered to the developing roller at the first nip portion is pushed back through the toner circulation path from the first region through below the feed stabilizing member to the second region corresponding to a place upper than the feed stabilizing member on one side opposite to the first region side by pressure of the toner that tends to accumulate in the first region. The toner pushed back to the second region is fed again to the second nip portion along with the rotation of the feed roller, and reaches the first region. In this way, toner is circulated through the toner circulation path. Thus, occurrence of toner packing can be prevented. As a result of this, deterioration of image quality or breaks of the gears due to the toner packing is never caused. Also in this developing device, since the toner is pushed back through the toner circulation path up to the second region by the pressure itself of the toner that tends to accumulate in the first region, there is no need for providing such toner agitating/conveying members etc. as disclosed in the prior art. Accordingly, the developing device of the invention can be made up in small size with simplicity.

In addition, it is desirable to provide a restricting member which is set in the housing in contact with a lower portion of the developing roller on a rotational-direction downstream side of the first nip portion so as to restrict toner present on the developing roller.

Desirably, the restricting member and the feed stabilizing member extend along the axial direction of the rollers.

An image forming apparatus according to the present invention includes the developing device.

BRIEF DESCRIPTION OF DRAWINGS

The present invention will become more fully understood from the detailed description given hereinbelow and the accompanying drawings which are given by way of illustration only, and thus are not limitative of the present invention, and wherein:

FIG. 6 is a view showing an evaluation result of a verification experiment performed on the developing device.

DESCRIPTION OF EMBODIMENTS

Hereinbelow, the present invention will be described in detail by way of embodiments thereof illustrated in the accompanying drawings.

Figure 1:
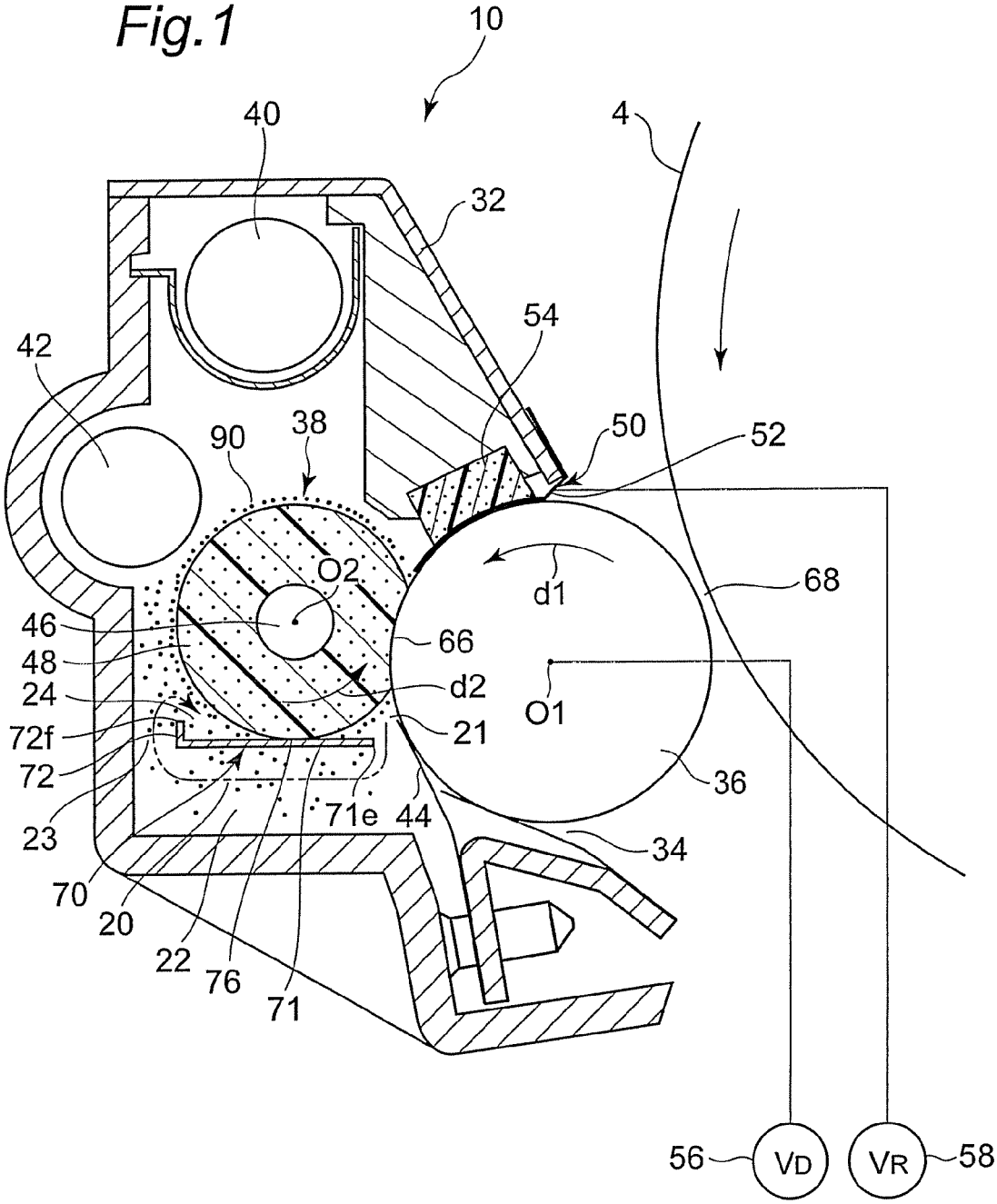
FIG. 1 is a view showing a vertically cut cross-sectional structure of a developing device according to an embodiment of the invention.

FIG. 1 shows a view showing a vertically cut cross-sectional structure of a developing device 10 according to an embodiment of the invention. The developing device 10 roughly includes a developing roller 36, a feed roller 38 for feeding toner to the developing roller 36, a feed stabilizing member 70 for stabilizing the feed of toner, and a housing 32 for housing these rollers 36, 38 and the feed stabilizing member 70 together with toner 90.

The toner 90 is, for example, nonmagnetic one-component toner that is negatively charged, to which an external additive containing strontium titanate is added as required. A diameter of the toner 90, which is not particularly limited, is 6 μm to 7 μm as an example. The invention does not prohibit the use of toner that is positively charged.

In the housing 32, a toner-feed use opening 34 extending in horizontal directions vertical to the drawing sheet of FIG. 1 is formed.

The developing roller 36 extends in a direction vertical to the drawing sheet of FIG. 1 in a manner of roughly closing the opening 34 of the housing 32. The feed roller 38 is provided along the developing roller 36 in the housing 32 at a height level roughly equal to that of the developing roller 36. The developing roller 36 and the feed roller 38, having unshown rotating shafts parallel to each other, respectively, are so provided as to be rotatable around their centers O1, O2 in pressure contact with each other. Thus, the developing roller 36 and the feed roller 38 form a nip portion 66 as a first nip portion. The developing roller 36 and the feed roller 38 are coupled to unshown motors or other drive sources, and rotated counterclockwise based on the driving by the drive source as shown by arrows d1, d2 in the figure. As a result, outer peripheral surfaces of the developing roller 36 and the feed roller 38 slide in contact with each other in counter directions at the nip portion 66 between the developing roller 36 and the feed roller 38. A specific construction of the developing roller 36 and the feed roller 38 will be described later.

Figure 5:
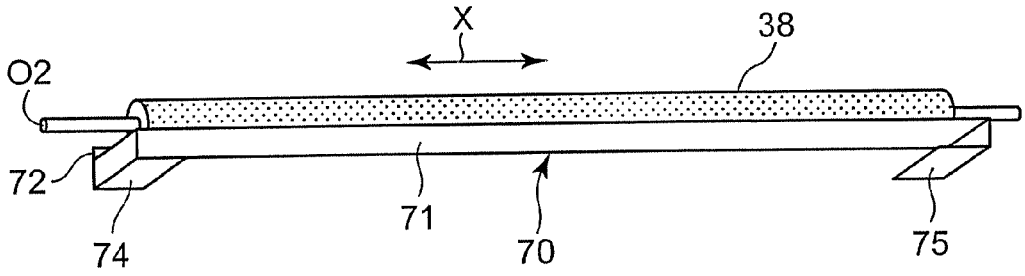
FIG. 5 is a view of a feed stabilizing member included in the developing device as viewed from obliquely downward together with the feed roller.

The feed stabilizing member 70 is placed in the housing 32 along the lowermost portion of the feed roller 38. The feed stabilizing member 70, as shown in FIG. 5, has a horizontal plate portion 71 extending in a longitudinal direction X of the feed roller 38 (i.e., a horizontal direction vertical to the drawing sheet of FIG. 1), a vertical plate portion 72 extending upward from a one-side (left side of FIG. 1) side edge of the horizontal plate portion 71, and L-shaped support portions 74, 75 provided at opposite ends of the horizontal plate portion 71 in the longitudinal direction X. The feed stabilizing member 70 is fixed to the housing 32 via the support portions 74, 75. As shown in FIG. 1, the horizontal plate portion 71 of the feed stabilizing member 70 is in pressure contact from below with the lowermost portion of the feed roller 38. As a result, the horizontal plate portion 71 of the feed stabilizing member 70 and the feed roller 38 form a nip portion 76 as a second nip portion. As to the feed roller 38, the nip portion 76 against the feed stabilizing member 70 is located more upstream in the rotational direction than the aforementioned nip portion 66 against the developing roller 36. Although not shown in detail, the feed roller 38 is pushed inward at the nip portion 76 by the feed stabilizing member 70 so as to be dented from a natural state by about 0.5 mm in this example.

In the cross section of FIG. 1, a right-side end portion 71*e* of the horizontal plate portion 71 of the feed stabilizing member 70 in FIG. 1 extends up to a generally central portion of a generally triangular-shaped or sectorial-shaped region (referred to as "first region") 21 which is surrounded by a portion of the developing roller 36 lower than the nip portion 66 and a portion of the feed roller 38 lower than the nip portion 66 so that the right-side end portion 71*e* becomes closer to the developing roller. The horizontal plate portion 71 of the feed stabilizing member 70 extends from the first region 21 up to one side of the nip portion 76 opposite to the first region 21 side (i.e., to the left side in FIG. 1), and adjoins the vertical plate portion 72. An upper end 72*f* of the vertical plate portion 72 is positioned upper than the nip portion 66. In this cross section of FIG. 1, on the side of the nip portion 76 opposite to the first region 21 side, a region above the feed stabilizing member 70, more specifically, a region surrounded roughly by the horizontal plate portion 71, the vertical plate portion 72 and the feed roller 38 is referred to as a "second region" 24.

In this developing device 10 is formed a toner circulation path 20 passing from the first region 21 through below the horizontal plate portion 71 of the feed stabilizing member 70 and through the left side of the vertical plate portion 72 as viewed in FIG. 1 and reaching the second region 24. Below the horizontal plate portion 71 is formed a horizontal path 22 partitioned by a lower surface of the horizontal plate portion 71 and a horizontal surface 32*a* of the housing 32 (see FIG. 2) facing the lower surface. Also, on the left side of the vertical plate portion 72 is formed a vertical path 23 partitioned by a left side face of the vertical plate portion 72 as in FIG. 1 and a vertical surface 32*b* (see FIG. 2) of the housing 32 facing the left side face. The toner circulation path 20 makes the first region 21 communicated with the second region 24 through those horizontal path 22 and vertical path 23.

A restricting blade 44 made of a metal plate as a restricting member is provided near a lower edge of the opening 34 within the housing 32. The restricting blade 44 is in contact with a lower portion of the developing roller 36 on a rotational-direction downstream side of the nip portion 66 so as to restrict toner present on the outer peripheral surface of the developing roller 36.

The developing device 10 also has two conveying members 40, 42 implemented by screws or the like, so that the toner 90 within the housing 32 is circulated by those conveying members 40, 42.

A static elimination means 50 is provided near an upper edge of the opening 34 in the housing 32. The static elimination means 50 has an electroconductive member 52 set in contact with the developing roller 36, and a pusher member 54 for pushing the electroconductive member 52 against the developing roller 36.

A power supply 56 (development bias applying means) for applying a development bias $V_D$ to the developing roller 36 is connected to the developing roller 36.

A power supply 58 for applying to the electroconductive member 52 a static elimination bias $V_R$ whose polarity is opposite to that on the developing roller 36 is connected to the electroconductive member 52.

In this developing device 10, when the feed roller 38 is rotated counterclockwise as shown by an arrow d2, the toner 90 housed in the housing 32, particularly toner present around the feed roller 38, is conveyed along with the rotation of the feed roller 38 so as to be fed from the second region 24 to the nip portion 76 between the horizontal plate portion 71 of the feed stabilizing member 70 and the feed roller 38. Then, a feed quantity of toner from the feed roller 38 to the developing roller 36 is restricted at the nip portion 76. As the feed roller 38 is further rotated, the toner restricted at the nip portion 76 is conveyed so as to be fed to the nip portion (toner feed/collection region) 66 between the feed roller 38 and the developing roller 36. As a result, the toner is fed from the feed roller 38 to the developing roller 36, and is carried on the outer peripheral surface of the developing roller 36. At this point, the toner fed to the developing roller 36 is preliminarily charged by friction between the developing roller 36 and the feed roller 38. By the developing roller 36 being rotated counterclockwise as shown in arrow d1, the toner on the outer peripheral surface of the developing roller 36 fed from the feed roller 38 is fed to a contact portion between the developing roller 36 and the restricting blade 44. Then, by the restricting blade 44, the toner on the outer peripheral surface of the developing roller 36, while restricted in its layer thickness, is further charged by its frictional contact with the restricting blade 44. As the developing roller 36 is further rotated, the restricted and charged toner on the outer peripheral surface of the developing roller 36 reaches a development region 68 at which the photoconductor 4 and the developing roller 36 face each other. The toner having reached the development region 68 adheres to an electrostatic latent image (image forming portion) carried on the photoconductor 4 so as to form a toner image on an outer peripheral surface of the photoconductor 4.

Toner that has not been used for development but has been left on the outer peripheral surface of the developing roller 36 after passing through the development region 68 reaches contact portion between the developing roller 36 and the electroconductive member 52 along with the rotation of the developing roller 36, where the toner is subjected to static elimination by the electroconductive member 52 so as to set more easily peeled from the developing roller 36. Thereafter, along with the rotation of the developing roller 36, the more easily peelable toner reaches the nip portion 66 between the feed roller 38 and the developing roller 36, thus collected by the feed roller 38.

In this case, when the toner is fed from the feed roller 38 to the developing roller 36 at the nip portion 66, toner that has not adhered to the developing roller 36 tends to accumulate in the first region 21. In this developing device 10, the toner that has not been adhered to the developing roller 36 at the nip portion 66 is pushed back from the first region 21 through the toner circulation path 20 to the second region 24 by pressure of the toner that tends to accumulate in the first region 21. That is, the toner is pushed back from the first region 21 to the second region 24 by passing sequentially through the horizontal path 22, which is below the horizontal plate portion 71 of the feed stabilizing member 70, and the vertical path 23, which is located on the left side of the vertical plate portion 72. The toner pushed back to the second region 24 is fed again to the nip portion 76 along with the rotation of the feed roller 38, and reaches the first region 21. In this way, toner is circulated through the toner circulation path 20. Thus, occurrence of toner packing can be prevented. As a result of this, deterioration of image quality or breaks of the gears due to the toner packing is never caused. Also in this developing device 10, since the toner is pushed back through the toner circulation path 20 up to the second region 24 by the pressure itself of the toner that tends to accumulate in the first region 21, there is no need for providing such toner agitating/conveying members etc. as disclosed in the prior art. Accordingly, the developing device 10 can be made up in small size with simplicity.

As the developing roller 36, common ones which have heretofore been used in the field of developing devices are usable. The developing roller 36 may be, for example, a metal roller formed of a core metal alone of aluminum, stainless steel or the like as an electroconductive material, or a composite roller formed of a core metal and a coating layer made of acrylonitrile-butadiene rubber formed on the outer peripheral surface of the core metal. The coating layer, which may be in either a single layer structure or a multilayer structure of two or more layers, is preferably in a two-layer structure of an intermediate layer and a top layer in this example. A diameter of the developing roller 36 is desirably within a range of 10 mm-25 mm, and set to 16 mm in this example. An axial size of the developing roller 36 is set to 220 mm in this example.

The feed roller 38 is made up of a round-bar core metal 46, and a foaming layer 48 formed on the outer periphery of the core metal 46. A material of the core metal 46 is, for example, iron, stainless steel, aluminum or other electroconductive material or resin or the like. A surface of the core metal 46 may be plated for prevention of corrosion or the like. Resin foam or rubber foam is used as a material of the foaming layer 48 and, more specifically, polyurethane foam excellent in durability is desirably used. Concrete examples of the material of the foaming layer 48 to be used other than polyurethane foam include foams of epoxy resin, acrylic resin or other thermosetting resins, foams of polyethylene, polystyrene or other thermoplastic resins. The foaming layer 48 has a hardness value within a range of, preferably, 50N to 200N and, desirably, 50N to 100N according to an experimental method of JIS-K6400. The feed roller 38 has a diameter within a range of, desirably, 10 mm-20 mm in a natural state, and the diameter is set to 12 mm in this example. An axial length of the feed roller 38 is set to 220 mm in this example in correspondence to an axial length of the developing roller 36.

The feed stabilizing member 70 is formed by bending a plate material made of a metal as an electroconductive material, a 0.2 mm thick stainless steel (SUS301) in this example in such a manner as shown in FIG. 5. With the formation of the feed stabilizing member 70 from a relatively small-in-thickness stainless steel as in this case, at least the horizontal plate portion 71 out of the feed stabilizing member 70 has flexibility. Accordingly, it becomes easier to adjust the pressure of contact between the horizontal plate portion 71 of the feed stabilizing member 70 and the feed roller 38. For example, when the feed roller 38 is rotated about the center O2, outer diameter fluctuations or decentering of the feed roller 38 as well as vibrations of the shaft of the feed roller 38 may cause variation factors for the way of contact between the horizontal plate portion 71 of the feed stabilizing member 70 and the feed roller 38. Even if such variation factors have occurred, the horizontal plate portion 71 of the feed stabilizing member 70 are flexed so as to absorb those variations. Thus, the way of contact between the horizontal plate portion 71 of the feed stabilizing member 70 and the feed roller 38 is stabilized. As a result, the toner feed from the feed roller 38 to the developing roller 36 can be stabilized.

Further, with the feed stabilizing member 70 formed from an electroconductive material as shown above, it becomes possible to control a potential of the feed stabilizing member 70. That is, by exerting control so that the potential of the feed stabilizing member 70 is equalized, for example, to a potential of the feed roller 38 to preliminarily charge the toner, toner feed from the feed roller 38 to the developing roller 36 can be stabilized. In addition, connection of a power supply to the feed stabilizing member 70 can be made, for example, on the support portions 74, 75 shown in FIG. 5.

Figure 2:
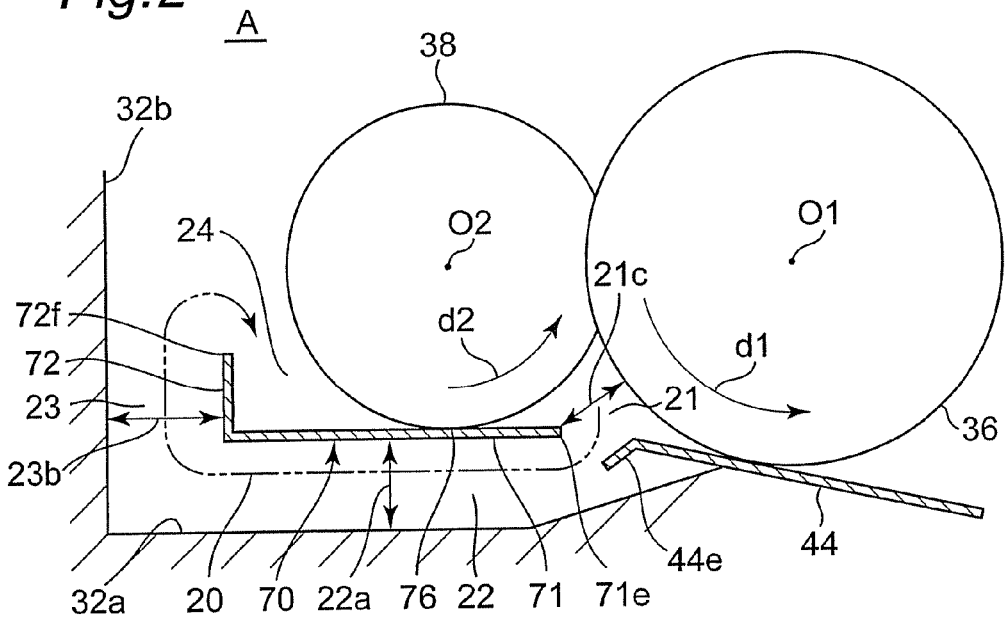
FIG. 2 is a view showing one structure type of the developing device.
Figure 3:
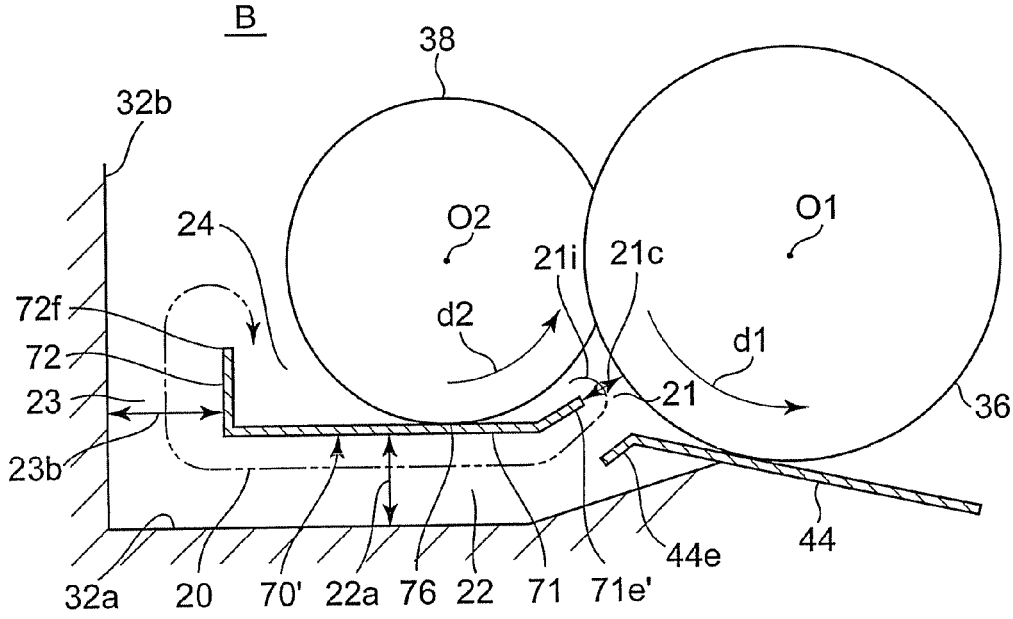
FIG. 3 is a view showing another type of the developing device.
Figure 4:
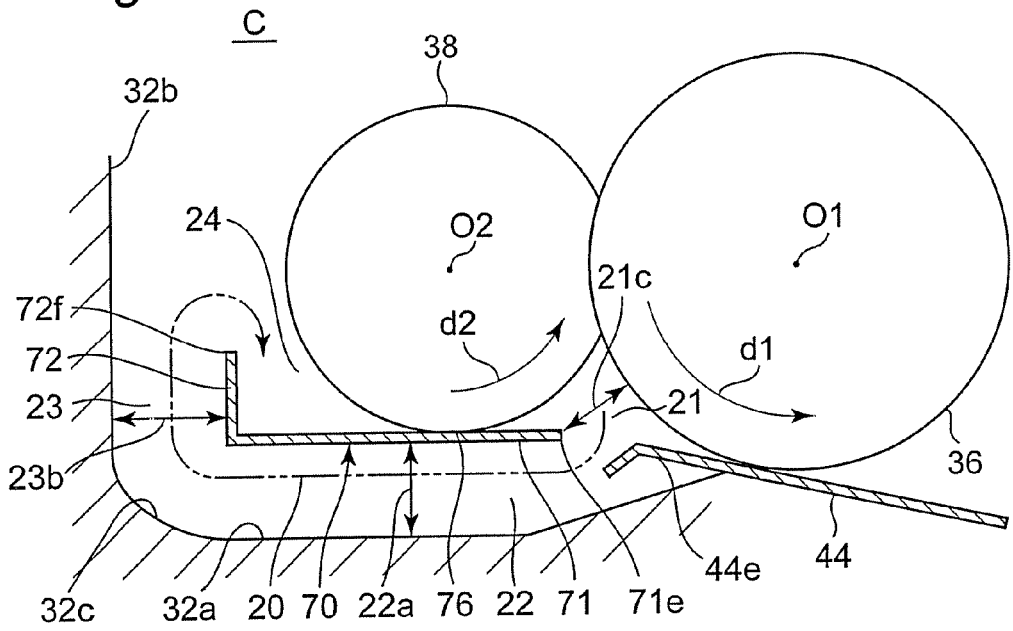
FIG. 4 is still another structure type of the developing device.

The present inventor performed a verification experiment on the invention under conditions that a developing unit used in a color laser printer (trade name: magicolor 5570) made by Konica Minolta was modified into structure types A, B, C as shown in FIGS. 2, 3 and 4, respectively, while design parameters such as dimensions of the horizontal path 22 and the vertical plate portion 72 were changed in various ways.

The structure type A shown in FIG. 2 is substantially identical to the structure shown in FIG. 1. In the cross section shown, a vertical length of the horizontal path 22 is denoted by 22*a*, a horizontal length of the vertical path 23 is denoted by 23*b*, and a distance between the end portion 71*e* of the horizontal plate portion 71 of the feed stabilizing member 70 and the developing roller 36 is denoted by 21*c*.

In this structure type A, the material of the feed stabilizing member 70 is given by SUS301 and set to a thickness of 0.2 mm as already described, a left-and-right direction length of the horizontal plate portion 71 in the cross section shown in the drawings is set to 11 mm, and a longitudinal-direction (X-direction in FIG. 5) length of the horizontal plate portion 71 is set to 220 mm in correspondence to the axial length of the developing roller 36 and the feed roller 38. The vertical length of the vertical plate portion 72 is set to 2.5 mm. A dent length of the feed roller 38 from the natural state caused by pushing by the feed stabilizing member 70 is set to 0.5 mm.

The structure type B shown in FIG. 3 differs from the structure type A in that an end portion (denoted by reference sign 71*e*') of the horizontal plate portion 71 of a feed stabilizing member (denoted by reference sign 70') is bent obliquely upward at a bending angle of 45° in this example so as to be closer to the developing roller 36. In this case, the end portion 71*e*' of the feed stabilizing member 70' extends up to a generally central portion of the first region 21. As a result of this, the distance 21*c* between the end portion 71*e*' of the feed stabilizing member 70' and the developing roller 36 is set to 2 mm. In this arrangement, toner that has not adhered to the developing roller 36 at the nip portion 66 does not stay as a vortex flow (having a center vertical to the drawing sheet of FIG. 3) in the first region 21 but is easily pushed out from the nip portion 66 downward beyond the end portion 71*e*' of the feed stabilizing member 70' as indicated by reference sign 21*i*. As a result, a toner flow along the toner circulation path 20 is likely to occur. Thus, the toner circulation path reliably functions as a flow path for circulating the toner.

In this structure type B, the material of the feed stabilizing member 70 is given by SUS301 and set to a thickness of 0.2 mm as already described, a left-and-right direction length of the horizontal plate portion 71 in the cross section shown in the drawings is set to 10 mm, and a longitudinal-direction (X-direction in FIG. 5) length of the horizontal plate portion 71 is set to 220 mm in correspondence to the axial length of the developing roller 36 and the feed roller 38. The vertical length of the vertical plate portion 72 is set to 2.5 mm. A dent length of the feed roller 38 from the natural state caused by pushing by the feed stabilizing member 70 is set to 0.5 mm.

The structure type C shown in FIG. 4 differs from the structure type A in that a corner portion (denoted by reference sign 32*c*) formed by the horizontal surface 32*a* and the vertical surface 32*b* of the housing 32 is formed round so as to have a circular-arc shaped cross section.

In this structure type C, the material of the feed stabilizing member 70 is given by SUS301 and set to a thickness of 0.2 mm as in the foregoing structure type A, a left-and-right direction length of the horizontal plate portion 71 in the cross section shown in the drawings is set to 11 mm, and a longitudinal-direction (X-direction in FIG. 5) length of the horizontal plate portion 71 is set to 220 mm in correspondence to the axial length of the developing roller 36 and the feed roller 38. The vertical length of the vertical plate portion 72 is set to 2.5 mm. A dent length of the feed roller 38 from the natural state caused by pushing by the feed stabilizing member 70 is set to 0.5 mm.

A table of FIG. 6 shows various types of developing unit samples manufactured with the structure types A, B, C and design parameters or the like changed, as well as evaluation results obtained in the verification experiment, in their correspondence.

The individual samples are identified by Nos. C1, C2, C3, E1, E2, . . . , E9 given in the leftmost field in the table.

A 'feed stabilizing member' field in the table represents the presence or absence of the feed stabilizing member 70. A 'structure type' field represents the structure types A, B, C as shown in FIGS. 2, 3, 4. A 'length 22*a*' field represents a vertical length of the horizontal path 22, a 'length 23*b*' field represents a horizontal length of the vertical path 23, and a 'distance 21*c*' field represents a distance between the end portion 71*e* of the horizontal plate portion 71 of the feed stabilizing member 70 and the developing roller 36 each in the unit of millimeter (mm). A 'potential' field represents whether or not a potential of the feed stabilizing member 70 has been controlled so as to be equal to a potential of the feed roller 38, or has been set to be a float potential (with no bias).

'Evaluation' fields in the table represent an evaluation result of 'feed stability,' an evaluation result of 'toner packing,' and their 'total' evaluation result.

The evaluation of 'feed stability' is as follows. First, deteriorated toner subjected to 2000-sheet printing of an image having a printing ratio of 1% with a color laser printer (trade name: magicolor 5570) made by Konica Minolta was collected. The deteriorated toner was filled into housings of developing unit samples C1, C2, C3, E1, E2, . . . , E9, respectively. Then, with those developing unit samples set up in the color laser printer, a solid image was printed under a high-temperature, high-humidity environment (with a 30° C. air temperature and an 85% humidity), and qualities of printed images were evaluated. These conditions for evaluation are those under which, generally, the toner fluidity is poor and moreover the toner charging amount is low such that a feed stability could hardly be obtained. A symbol '○' representing an evaluation result of 'feed stability' shows a level that there is no density difference between leading end and tailing end of the image. A symbol 'Δ' shows that there is a slight density difference between leading end and tailing end of the image but the density difference is of an inconsiderable level. A symbol 'x' shows a level that there is a density difference between leading end and tailing end of the image such as to allow an image deterioration to be recognized.

The evaluation of 'toner packing' is as follows. First, unused toner was filled into housings of developing unit samples C1, C2, C3, E1, E2, . . . , E9, respectively. Then, with those developing unit samples set up in a color laser printer (trade name: magicolor 5570) made by Konica Minolta, a solid image having a printing ratio of 0% was printed by 200 sheets under a low-temperature, low-humidity environment. Thereafter, a state of toner packing in each of the developing unit samples was observed. These conditions for evaluation are those under which, generally, the toner fluidity is favorable and moreover its bulk density is high such that a toner packing would be likely to be caused. A symbol '○' representing an evaluation result of 'toner packing' shows that both image and drive are successful. A symbol 'Δ' shows that there has occurred slight gear-pitch noise in the image. A symbol 'x' shows that with toner packing caused, there has occurred gear-pitch noise in the image. A symbol 'xx' shows that with toner packing caused, there has occurred a gear-skip.

An evaluation of 'total' is a total of 'feed stability' and 'toner packing.' A symbol '○' representing an evaluation result of 'total' shows that the result is successful. A symbol 'x' shows that the result is poor.

As can be understood from evaluation results in the table, first, without the feed stabilizing member 70 (developing unit sample C1), the feed stability was poor and the total evaluation was poor.

Next, analysis is performed primarily in a case with a feed stabilizing member 70 provided and with the structure type A set.

As can be seen from the developing unit sample C2, when both the vertical length 22*a* of the horizontal path 22 and the horizontal length 23*b* of the vertical path 23 were 0.5 mm, toner packing occurred to an extreme extent, so that the total evaluation was poor. In contrast to this, as can be seen from the developing unit sample El as an example, when both the vertical length 22*a* of the horizontal path 22 and the horizontal length 23*b* of the vertical path 23 were over 0.5 mm, no toner packing occurred, so that the total evaluation was successful. Thus, to prevent the occurrence of toner packing, it is desirable that a size of a cross section vertical to the flow direction of toner is over 0.5 mm, more reliably, over 1.5 mm.

As can be seen from the developing unit sample E3, with a 3 mm vertical length 22*a* of the horizontal path 22 and a 3 mm horizontal length 23*b* of the vertical path 23, the toner packing was evaluated as '○' and the total evaluation was successful. In contrast to this, as can be seen from the developing unit samples E5, C3, with a 3 mm vertical length 22*a* of the horizontal path 22, extremely extended horizontal lengths 23*b* of the vertical path 23 as 10 mm and 30 mm caused the toner packing to result in 'Δ' and 'x'. Further, as can be seen from the developing unit sample E4, with a 5 mm vertical length 22*a* of the horizontal path 22, an extremely inverted-in-magnitude horizontal length 23*b* of the vertical path 23 as 1 mm caused the toner packing to result in 'Δ'. As a result of these, for prevention of occurrence of toner packing, it is desirable that the size of a cross sectional vertical to the direction of toner flow is free from any extreme change, more reliably, substantially constant. In this respect, the developing unit sample E9 set to the structure type C also showed a '○' result of toner packing and a successful result of total evaluation.

In the developing unit samples E1, E6, E7, with a 3 mm vertical length 22*a* of the horizontal path 22 and a 1.5 mm horizontal length 23*b* of the vertical path 23 both free from any extreme change, the distance 21*c* between the end portion 71*e* of the horizontal plate portion 71 of the feed stabilizing member 70 and the developing roller 36 was set to 2 mm, 6 mm, 1 mm, respectively. The developing unit samples E1 and E7, in which the distance 21*c* was a relatively small and the end portion 71*e* extended up to a central portion of the first region 21, showed a '○' result of toner packing and a successful result of total evaluation. In contrast to this, the developing unit sample E6, in which the distance 21*c* was as long as 6 mm, showed a 'Δ' result of toner packing. As a result of this, for prevention of occurrence of toner packing, it is desirable that the end portion 71*e* of the horizontal plate portion 71 of the feed stabilizing member 70 extends up to the central portion of the first region 21 so as to be closer to the developing roller 36. In this respect, the developing unit sample E8 set to the structure type B showed a '○' result of toner packing and a successful result of total evaluation.

The developing unit samples E1, E2, with a 3 mm vertical length 22*a* of the horizontal path 22 and a 1.5 mm horizontal length 23*b* of the vertical path 23 both free from any extreme change, differ from each other in whether the potential of the feed stabilizing member 70 has been controlled so as to be equal to the potential of the feed roller 38 or has been set to be a float potential (with no bias). The developing unit sample E1 with the control to equal potential showed a '○' result of feed stability, while the developing unit sample E2 with the setting to a float potential showed a 'Δ' result of feed stability. As a result of this, it is desirable that the potential of the feed stabilizing member 70 is set equal to the potential of the feed roller 38. Thus, toner feed from the feed roller 38 to the developing roller 36 can be stabilized by preliminarily charging the toner.

For prevention of occurrence of toner packing, it is desirable that the length from the first region 21 to the second region 24 of the toner circulation path 20 is within a range of 5 mm to 20 mm. If the above length of the toner circulation path 20 is excessively short, a toner flow downward from the first region 21 cannot be formed effectively, posing a possibility that toner circulation becomes hard to fulfill. Meanwhile, if the above length of the toner circulation path 20 is excessively long, there arises a possibility that toner packing occurs on the way of the toner circulation path 20.

In the above-described embodiment, the horizontal plate portion 71 of the feed stabilizing member 70, while in a horizontal state, is in contact with the feed roller 38 from below. However, without being limited to this, the horizontal plate portion 71 (particularly its top face) of the feed stabilizing member 70 may be in contact with the feed roller 38 from below while being in an inclined state relative to a plane.

Also as shown in FIGS. 2, 3 and 4, an end portion 44e of the restricting blade 44 in the housing may be bent downward so as to aid the downward flow of toner from the first region 21. Also, although a plate-shaped restricting blade is provided as the restricting member in the foregoing embodiment, the restricting member is not limited to this and may be a roller-shaped one.

Figure 7:
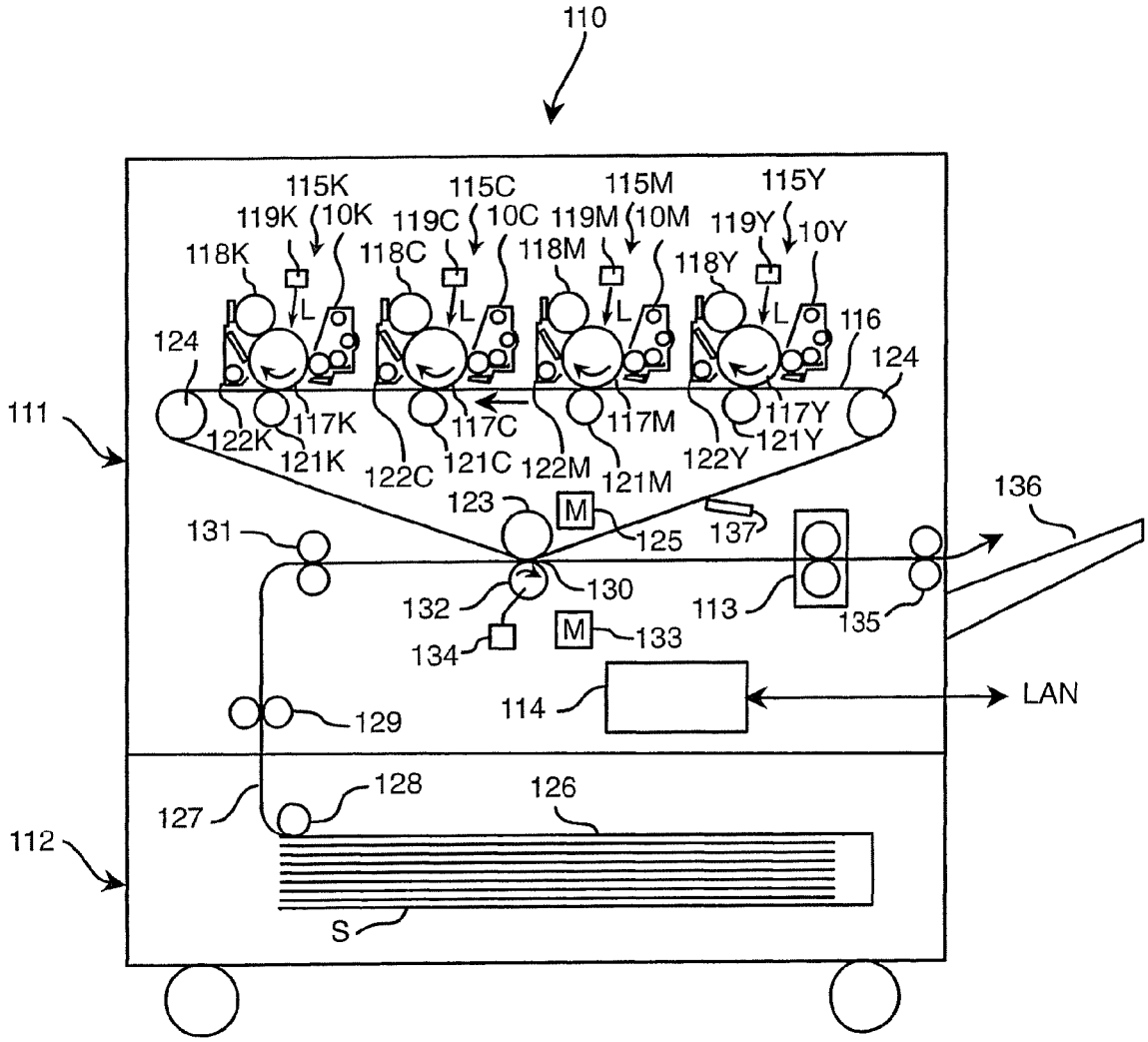
FIG. 7 is a view showing a structure of an image forming apparatus having the developing device according to an embodiment.

The developing device of the above-described embodiment is applicable to conventional monochrome and color image forming apparatuses. As an example of application, a tandem type image forming apparatus is shown in FIG. 7. The image forming apparatus of FIG. 7 is a printer having a developing device for yellow, a developing device for magenta, a developing device for cyan and a developing device for black.

As shown in FIG. 7, the printer 110, which forms an image by a known electrophotographic system, includes an image processing section 111, a feed section 112, a fixing section 113, and a control section 114. The printer 110 is connected to a network such as LAN (Local Area Network), and upon reception of an instruction for execution of a print job from an external terminal device (not shown), forms a color image composed of yellow, magenta, cyan and black colors according to the execution instruction. Hereinbelow, the reproduction colors of yellow, magenta, cyan and black colors will be expressed as Y, M, C and K, and these characters of Y, M, C and K will be added as suffixes to reference signs of members related to the reproduction colors.

The image processing section 111 as an image forming section includes image forming sections 115Y, 115M, 115C, 115K corresponding to the reproduction colors Y, M, C, K, respectively, an intermediate transfer belt 116, and the like.

The image forming sections 115Y-115K include, respectively, photoconductor drums 117Y-117K, chargers provided around the photoconductor drums 117Y-117K, respectively, exposers 119Y-119K, developing units 10Y-10K, primary transfer rollers 121Y-121K, cleaners 122Y-122K for cleaning the photoconductor drums 117Y-117K, respectively, or the like, and act to form toner images of the reproduction colors Y, M, C, K on the photoconductor drums 117Y-117K, respectively. The exposer 119Y internally has a laser diode, a polygon mirror for deflecting a laser beam emitted from the laser diode so that a surface of the photoconductor drum 117Y exposed and scanned in a main scanning direction, a scanning lens or the like. The other exposers 119M-119K are similar in construction.

The intermediate transfer belt 116 constituting the image processing section 111, which is an endless belt, is stretched by a driving roller 123 and a driven roller 124 and driven into rotation in an arrow direction by a belt driving motor 125.

The feed section 112 includes a sheet feed cassette 126 for accommodating paper sheets S as recording sheets, a feed-out roller 128 for feeding out the sheets S in the sheet feed cassette 126 one by one onto a conveyance path 127, a conveyance roller pair 129 for conveying the rolled-out sheet S, a timing roller pair 131 for taking a timing of feeding-out of the sheet S to a secondary transfer position 130, and a secondary transfer roller 132 which is to be set in pressure contact with the driving roller 123 at the secondary transfer position 130 with the intermediate transfer belt 116 interposed therebetween.

The secondary transfer roller 132, which is an electroconductive elastic roller foamed by, for example, adding ionic conductive substances to NBR (nitrile rubber), is driven by a secondary-transfer-roller driving motor 133 so as to be driven into rotation in the arrow direction. Also, a secondary transfer voltage outputted from a secondary transfer voltage output part 134 is applied to the secondary transfer roller 132. As a result, an electrostatic force for secondary transfer acts between the secondary transfer roller 132 and the driving roller 123.

The fixing section 113, having a fixing roller and a pressure roller, heats and pressures the sheet S with a specified fixing temperature to fix a toner image thereon.

The control section 114 converts image signals derived from the external terminal device into digital signals for the reproduction colors Y, M, C, K to generate drive signals for driving the laser diodes of the exposers 119Y-119K. Then, the laser diodes of the exposers 119Y-119K are driven by the generated drive signals to emit laser beams L, by which the photoconductor drums 117Y-117K are exposed and scanned.

In this case, before the exposure and scanning by the exposers 119Y-119K is performed, the photoconductor drums 117Y-117K are uniformly charged by the chargers 118Y-118K in advance. Then, by the exposure and scanning with the laser beams L from the exposers 119Y-119K, electrostatic latent images are formed on the photoconductor drums 117Y-117K.

Then, the electrostatic latent images are developed with toner by the developing units 10Y-10K, respectively. Toner images on the photoconduictor drums 117Y-117K obtained in this way are primarily transferred onto the intermediate transfer belt 116 by the electrostatic force acting between the primary transfer rollers 121Y-121K and the photoconductor drums 117Y-117K. During this operation, image-forming operations for the individual colors are executed with shifted timings so that the toner images for the individual colors are transferred in superimposition at an identical position on the intermediate transfer belt 116. Thus, the toner images of individual colors primarily transferred in superimposition on the intermediate transfer belt 116 are moved to the secondary transfer position 130 by rotation of the intermediate transfer belt 116.

With timing adjusted to the above-described individual-color image forming operations on the intermediate transfer belt 116, the sheet S is fed from the feed section 112 by the timing roller pair 131. The sheet S is conveyed as it is nipped between the intermediate transfer belt 116 and the secondary transfer roller 132, where the toner images on the intermediate transfer belt 116 are secondarily transferred collectively onto the sheet S by the electrostatic force acting to between the secondary transfer roller 132 as the transfer roller and the driving roller 123.

Thus, the sheet S that has passed through the secondary transfer position 130 is conveyed to the fixing section 113. At the fixing section 113, the toner images are heated and pressured so as to be fixed to the sheet S, and then the sheet S is discharged by a discharge roller 135 and accommodated in an accommodation tray 136.

As is described above, a developing device according to the present invention comprises:

a housing in which nonmagnetic one-component toner is housed;

a developing roller which horizontally extends in an opening of the housing;

a feed roller which is set in the housing parallel to the developing roller in pressure contact with the developing roller so as to form a first nip portion and which is rotated in a direction equal to a rotational direction of the developing roller so as to feed toner to the developing roller; and a feed stabilizing member which is placed within the housing and is in contact with an upstream-side portion of the feed roller lower than the first nip portion, the upstream side being referred to along the rotational direction, so as to form a second nip portion, and which restricts toner feed quantity from the feed roller to the developing roller, the feed stabilizing member being provided so as to extend from a generally triangular-shaped first region, which is surrounded by a portion of the developing roller lower than the first nip portion and a portion of the feed roller lower than the first nip portion, to one side of the second nip portion opposite to the first region side; and a toner circulation path for pushing back toner from the first region through below the feed stabilizing member to a second region corresponding to a place upper than the feed stabilizing member on the one side of the second nip portion opposite to the first region side with an aid of pressure of toner that tends to accumulate in the first region.

In the developing device of one embodiment, a size of a cross section of the toner circulation path vertical to a direction of flow of the toner is substantially constant.

In the developing device of this one embodiment, since the size of a cross section of the toner circulation path vertical to the direction of flow of the toner is substantially constant, the toner becomes less likely to stay within the toner circulation path. Therefore, toner circulation along the toner circulation path is facilitated, so that occurrence of toner packing can be prevented more reliably.

In the developing device of one embodiment, a size of a cross section of the toner circulation path vertical to a direction of flow of the toner is over 0.5 mm.

In the developing device of this one embodiment, since the size of a cross section of the toner circulation path vertical to the direction of flow of the toner is over 0.5 mm, the toner becomes less likely to stay within the toner circulation path. Therefore, toner circulation along the toner circulation path is facilitated, so that occurrence of toner packing can be prevented more reliably.

In the developing device of one embodiment, a length of the toner circulation path from the first region to the second region is within a range of 5 mm to 20 mm.

It is noted here that the "length" of the toner circulation path refers to a length for passage along a route corresponding to the shortest distance within a cross section vertical to the direction of toner flow.

In the developing device of this one embodiment, since the length of the toner circulation path from the first region to the second region is within a range of 5 mm to 20 mm, this toner circulation path reliably functions as a flow passage for circulating the toner. In addition, if the above length of the toner circulation path were excessively short, a toner flow downward from the first region could not be formed effectively, posing a possibility that toner circulation becomes hard to fulfill. Meanwhile, if the above length of the toner circulation path were excessively long, there would arise a possibility that toner packing occurs on the way of the toner circulation path.

In the developing device of one embodiment, in a cross section vertical to center axes of the rollers, a first region-side end portion of the feed stabilizing member extends up to a central portion of the first region so as to be closer to the developing roller.

It is noted here that as to the terms "closer to the developing roller," the first region-side end portion of the feed stabilizing member may be such that a portion of the feed stabilizing member in contact with a lower portion of the feed roller is bent and closer to the developing roller.

In the developing device of this one embodiment, in a cross section vertical to center axes of the rollers, a first region-side end portion of the feed stabilizing member extends up to a central portion of the first region so as to be closer to the developing roller. Therefore, toner generated near the first nip portion between the developing roller and the feed roller in the first region is pushed out downward of the end portion of the feed stabilizing member, so that a toner flow along the toner circulation path is likely to occur. Thus, the toner circulation path reliably functions as a flow passage for circulating the toner.

In the developing device of one embodiment, each of the rollers contains a layer made of an electroconductive material, and the feed stabilizing member is made of an electroconductive material.

It is noted here that the term "electroconductive material" refers to, for example, metal.

In the developing device of this one embodiment, since the feed stabilizing member is made of an electroconductive material, potential control is enabled. By exerting control so that the potential of the feed stabilizing member is equalized, for example, to a potential of the feed roller to preliminarily charge the toner, toner feed from the feed roller to the developing roller can be stabilized.

In the developing device of one embodiment, a second region-side end portion of the feed stabilizing member is positioned upper than the second nip portion.

In the developing device of this one embodiment, a second region-side end portion of the feed stabilizing member is positioned upper than the second nip portion. Therefore, toner is more likely to accumulate in the second region. As a result, toner feed from the feed roller to the developing roller can be stabilized.

In the developing device of one embodiment, at least a portion of the feed stabilizing member forming the second nip portion is formed into a plate shape having flexibility.

In the developing device of this one embodiment, at least a portion of the feed stabilizing member forming the second nip portion is formed into a plate shape having flexibility. Accordingly, it becomes easier to adjust the pressure of contact between the feed roller and the feed stabilizing member. For example, when the feed roller is rotated about the center axis, outer diameter fluctuations or decentering of the feed roller as well as vibrations of the shaft of the feed roller may cause variation factors for the way of contact between the feed roller and the feed stabilizing member. Even if such variation factors have occurred, the feed stabilizing member is flexed so as to absorb those variations in this developing device. Thus, the way of contact between the feed roller and the feed stabilizing member is stabilized. As a result, the toner feed from the feed roller to the developing roller can be stabilized.

Although the present invention has been described in detail, it is apparent that numerous modifications may be made. It should be understood that unless departing from the spirit and scope of the invention, such modifications that will be apparent to those skilled in the art are intended to be embraced in the scope of the appended claims.

REFERENCE SIGNS LIST

10 developing device
20 toner circulation path
32 housing
36 developing roller
38 feed roller
70 feed stabilizing member Citation List Patent Literature
Patent Literature 1: JP 2006-98854 A
Patent Literature 2: JP 2006-98855 A
Patent Literature 3: JP 2007-3889 A
Patent Literature 4: JP 2002-244437 A
Patent Literature 5: JP 2003-107903 A

The invention claimed is:

1. A developing device comprising:
a housing in which nonmagnetic one-component toner is housed;
a developing roller which horizontally extends in an opening of the housing;
a feed roller which is set in the housing parallel to the developing roller in pressure contact with the developing roller so as to form a first nip portion and which is rotated in a direction equal to a rotational direction of the developing roller so as to feed toner to the developing roller; and
a feed stabilizing member which is placed within the housing and is in contact with an upstream-side portion of the feed roller lower than the first nip portion, the upstream side being referred to along the rotational direction, so as to form a second nip portion, and which restricts toner feed quantity from the feed roller to the developing roller, the feed stabilizing member being provided so as to extend from a generally triangular-shaped first region, which is surrounded by a portion of the developing roller lower than the first nip portion and a portion of the feed roller lower than the first nip portion, to one side of the second nip portion opposite to the first region side; and
a toner circulation path as a path where toner is pushed back from the first region through below the feed stabilizing member to a second region corresponding to a place upper than the feed stabilizing member on the one side of the second nip portion opposite to the first region side with an aid of pressure of toner that tends to accumulate in the first region.

2. The developing device as claimed in claim 1, wherein
a size of a cross section of the toner circulation path vertical to a direction of flow of the toner is substantially constant.

3. The developing device as claimed in claim 1, wherein
a size of a cross section of the toner circulation path vertical to a direction of flow of the toner is over 0.5 mm.

4. The developing device as claimed in claim 1, wherein
a length of the toner circulation path from the first region to the second region is within a range of 5 mm to 20 mm.

5. The developing device as claimed in claim 1, wherein
in a cross section vertical to center axes of the rollers, a first region-side end portion of the feed stabilizing member extends up to a central portion of the first region so as to be closer to the developing roller.

6. The developing device as claimed in claim 1, wherein
each of the rollers contains a layer made of an electroconductive material, and
the feed stabilizing member is made of an electroconductive material.

7. The developing device as claimed in claim 1, wherein
a second region-side end portion of the feed stabilizing member is positioned upper than the second nip portion.

8. The developing device as claimed in claim 1, wherein
at least a portion of the feed stabilizing member forming the second nip portion is formed into a plate shape having flexibility.

9. An image forming apparatus including the developing as defined in claim 1.

10. The image forming apparatus as claimed in claim 9, wherein
in the developing device, a size of a cross section of the toner circulation path vertical to a direction of flow of the toner is substantially constant.

11. The image forming apparatus as claimed in claim 9, wherein
a size of a cross section of the toner circulation path vertical to a direction of flow of the toner is over 0.5 mm.

12. The image forming apparatus as claimed in claim 9, wherein
in the developing device, a length of the toner circulation path from the first region to the second region is within a range of 5 mm to 20 mm.

13. The image forming apparatus as claimed in claim 9, wherein
in the developing device, in a cross section vertical to center axes of the rollers, a first region-side end portion of the feed stabilizing member extends up to a central portion of the first region so as to be closer to the developing roller.

14. The image forming apparatus as claimed in claim 9, wherein
in the developing device, each of the rollers contains a layer made of an electroconductive material, and
the feed stabilizing member is made of an electroconductive material.

15. The image forming apparatus as claimed in claim 9, wherein
in the developing device, a second region-side end portion of the feed stabilizing member is positioned upper than the second nip portion.

16. The image forming apparatus as claimed in claim 9, wherein in the developing device, at least a portion of the feed stabilizing member forming the second nip portion is formed into a plate shape having flexibility.

17. The image forming apparatus as claimed in claim 9, wherein, in the developing device, the feed stabilizing member has a first surface as a surface faced downward and a second surface as an end surface located opposite to the first region side with reference to the second nip portion;

the housing has a first inner wall surface facing the first surface and a second inner wall surface facing the second surface; and the toner circulation path includes at least a path portion defined by the feed stabilizing member and the first and second inner wall surfaces.

18. The developing device as claimed in claim 1, wherein the feed stabilizing member has a first surface as a surface faced downward and a second surface as an end surface located opposite to the first region side with reference to the second nip portion;

the housing has a first inner wall surface facing the first surface and a second inner wall surface facing the second surface; and the toner circulation path includes at least a path portion defined by the feed stabilizing member and the first and second inner wall surfaces.

19. The developing device as claimed in claim 1, wherein the feed stabilizing member possesses an end portion extending upwards and towards the developing roller so that the end portion forms an oblique angle with an other portion of the feed stabilizing member.

20. The developing device as claimed in claim 1, further comprising a restricting blade positioned in contact with the developing roller, the restricting blade possessing an end portion extending downwards and away from the developing roller so that the end portion forms an oblique angle with an other portion of the restricting blade.

* * * * *